US006402640B1

(12) United States Patent
Stuart

(10) Patent No.: US 6,402,640 B1
(45) Date of Patent: Jun. 11, 2002

(54) BALL THROWING DEVICE

(76) Inventor: Allen R. Stuart, 107 Alice St., Essex, IA (US) 51638

( * ) Notice: Subject to any disclaimer, the term of this patent is extended or adjusted under 35 U.S.C. 154(b) by 0 days.

(21) Appl. No.: 09/590,529

(22) Filed: Jun. 8, 2000

(51) Int. Cl.[7] ..... A63B 69/00

(52) U.S. Cl. ..... 473/422; 473/431; 128/6; 128/78

(58) Field of Search ..... 124/6, 7, 78, 34; 473/422, 431, 432, 451, 460, FOR 102, FOR 103, FOR 107, FOR 196; 273/317.2–317.7

(56) References Cited

U.S. PATENT DOCUMENTS

| | | | | |
|---|---|---|---|---|
| 2,918,915 A | * | 12/1959 | Doeg | 124/78 |
| 3,724,438 A | * | 4/1973 | Brandt | 124/32 |
| 4,080,950 A | | 3/1978 | Paulson et al. | |
| 4,197,827 A | * | 4/1980 | Smith | 124/78 |
| RE30,703 E | | 8/1981 | Paulson et al. | |
| 4,559,918 A | | 12/1985 | Ballerin et al. | |
| 5,338,025 A | | 8/1994 | Giovagnoli | |
| 5,722,384 A | | 3/1998 | Cox | |
| 5,826,568 A | | 10/1998 | Van Ross, Jr. | |

* cited by examiner

*Primary Examiner*—Paul T. Sewell
*Assistant Examiner*—Miltra Aryanpour
(74) *Attorney, Agent, or Firm*—Pitts & Brittian, P.C.

(57) ABSTRACT

A ball throwing device capable of throwing or pitching balls at more than one speed without having to readjust the device. The ball throwing device generally includes a base, a motor and at least two ball throwing assemblies. The motor is supported on the base and includes a mounting flange, a drive motor and an output shaft driven to rotate by the drive motor. The output shaft includes at least two tire flanges carried thereon. Each of the ball throwing assemblies includes a feeder assembly and a wheel. Each wheel defines a ball gripping surface and is mounted to a tire flange. Each wheel defines a different diameter. Each feeder assembly is supported proximate the ball gripping surface of one of the wheels to guide the ball to be thrown against it. The feeder assemblies are supported via the mounting flange.

3 Claims, 2 Drawing Sheets

BALL THROWING DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of Invention

This invention relates to the field of devices for throwing softballs, baseballs and balls of the like.

2. Description of the Related Art

Ball throwing devices are used for batting practice to avoid overworking the arms of pitchers. Ball throwing devices are also far more consistent once set up to throw a particular pitch than a human pitcher. Different versions of ball throwing devices have been developed over the years. Typical of the art are those devices disclosed in the following U.S. Patents:

| Patent No. | Inventor(s) | Issue Date |
|---|---|---|
| 4,080,950 | Paulson et al. | Mar. 28, 1978 |
| Re. 30,703 | Paulson et al. | Aug. 11, 1981 |
| 4,559,918 | Ballerin et al. | Dec. 24, 1985 |
| 5,338,025 | Giovagnoli | Aug. 16, 1994 |
| 5,722,384 | S. L. Cox | Mar. 3, 1998 |
| 5,826,568 | W. Van Ross, Jr. | Oct. 27, 1998 |

Re. 30,703 is a reissue of U.S. Pat. No. 4,080,950 and discloses a ball throwing device which includes a motor with an axle to which a tire is mounted. The device further includes a ball feeder assembly for directing the ball against the rotating tire. The speed of rotation of the tire and the ball feeder assembly are adjustable to control the height and speed of the thrown ball. A drawback with this device is that, once the device is set up, the batter gets into a "groove," where he can expect the same pitch at the same height and speed. Although the speed at which the ball is thrown is adjustable, it can take several minutes to make these adjustments. More specifically, the ball feeder assembly must also be adjusted when the speed of rotation of the tire is increased or decreased.

U.S. Pat. No. 4,559,918 discloses a ball throwing device specifically designed for throwing table tennis balls or tennis balls. The device includes two pairs of rollers through which balls are thrown. The rotation of each roller is independently controlled via a motor. The device is not designed to project balls over a plate, it is designed to throw balls such that they bounce. Further, the device includes four motors which can be unwieldy when trying to set up the throwing device.

U.S. Pat. No. 5,722,384 discloses a multidirectional ball throwing system which includes three input tubes which correlate to three output tubes. The output tubes are positioned such that balls are propelled in three different directions at the same speed. This ball throwing system would be of no value for use during batting practice. The balls need to be thrown over the plate in the strike zone for effective baseball and softball batting practice.

Therefore, it is an object of the present invention to provide a portable ball throwing device which is intended for use during batting practice and is capable of throwing softballs, baseballs, and balls of the into a hitting zone.

It is another object of the present invention to provide a ball throwing device which provides a choice of speeds at which a ball can be pitched without having to adjust the device in any way.

BRIEF SUMMARY OF THE INVENTION

Other objects and advantages will be accomplished by the present invention which provides a ball throwing device capable of throwing or pitching balls at more than one speed without having to readjust the device. The ball throwing device generally includes a base, a motor and at least two ball throwing assemblies. The motor is supported on the base and includes a mounting flange, a drive motor and an output shaft driven to rotate by the drive motor. The output shaft includes at least two tire flanges carried thereon. Each of the ball throwing assemblies includes a feeder assembly and a wheel. Each wheel defines a ball gripping surface and is mounted to a tire flange. Each wheel defines a different diameter. Each feeder assembly is supported proximate the ball gripping surface of one of the wheels to guide the ball to be thrown against it. The feeder assemblies are supported via the mounting flange.

BRIEF DESCRIPTION OF THE SEVERAL VIEWS OF THE DRAWINGS

The above mentioned features of the invention will become more clearly understood from the following detailed description of the invention read together with the drawings in which.

DETAILED DESCRIPTION OF THE INVENTION

Figure 1:
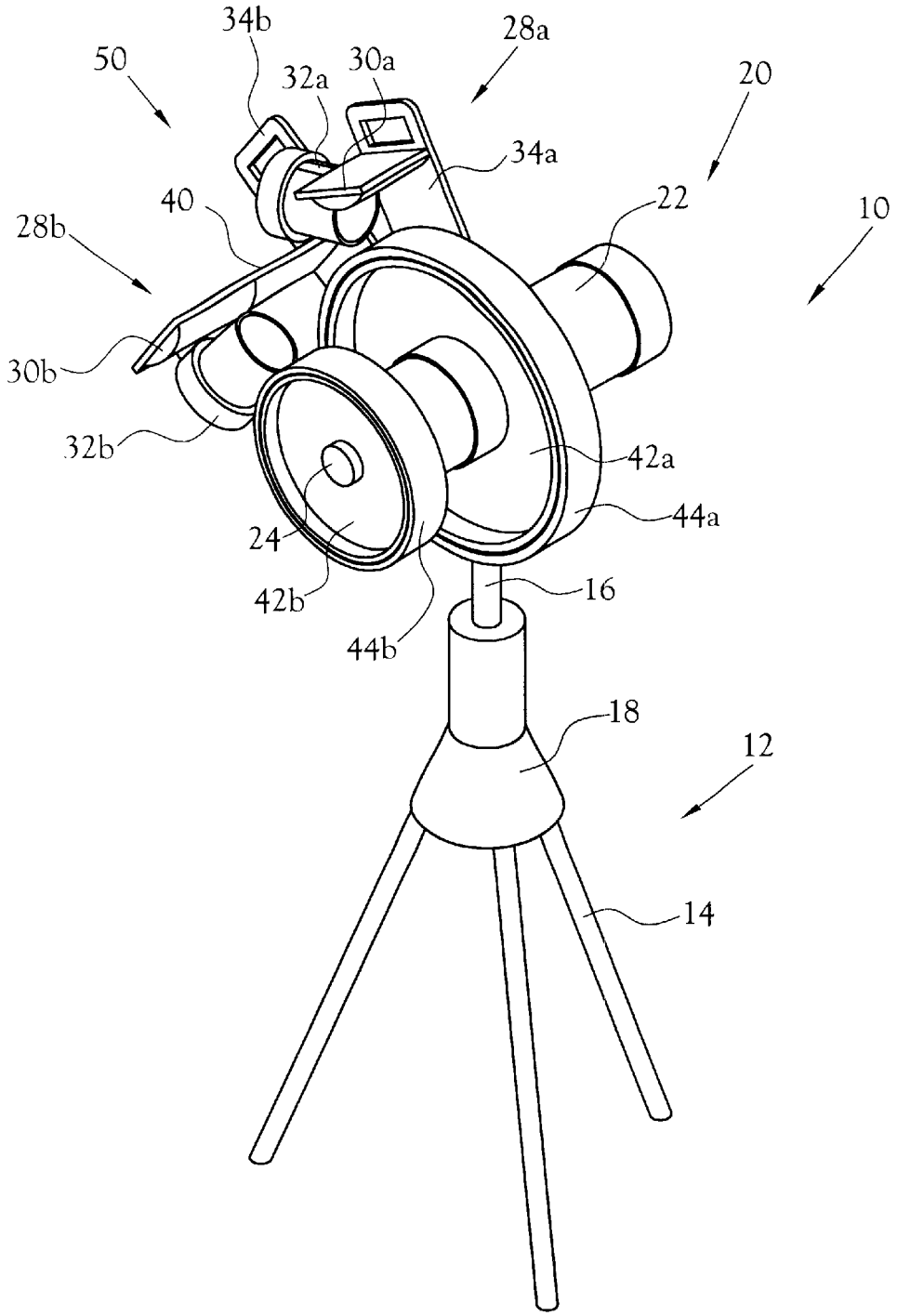
FIG. 1 is a perspective view of the ball throwing device constructed in accordance with several features of the present invention.
Figure 2:
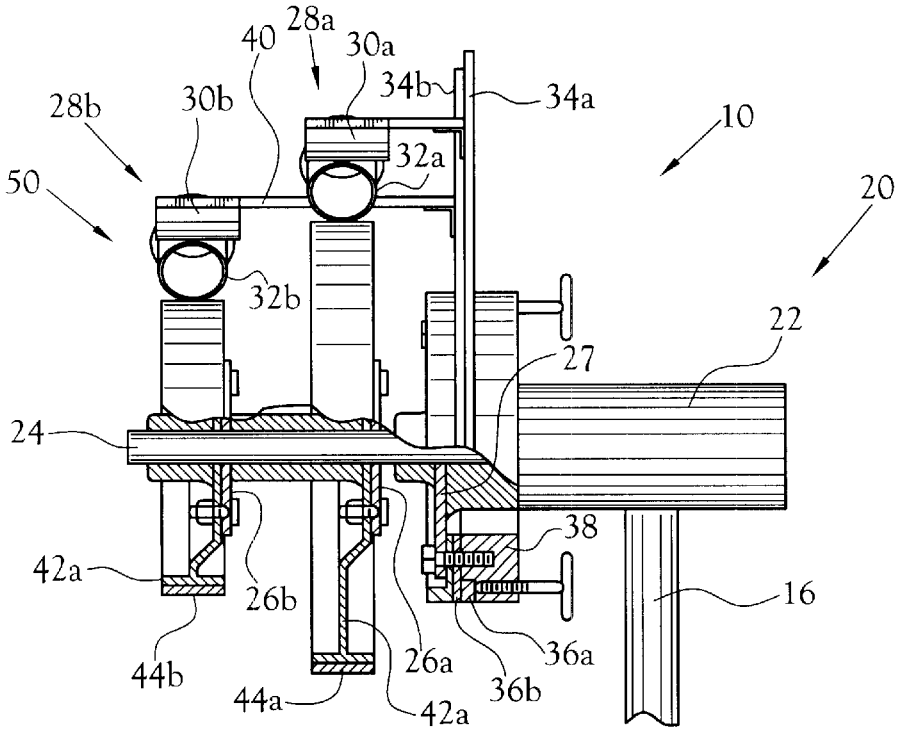
FIG. 2 illustrates an end view of the top portion of the ball throwing device of FIG. 1, shown partially in section; and, FIG. 3 is an end view of an alternate embodiment of the ball throwing device of the present invention, shown partially in section.
Figure 3:
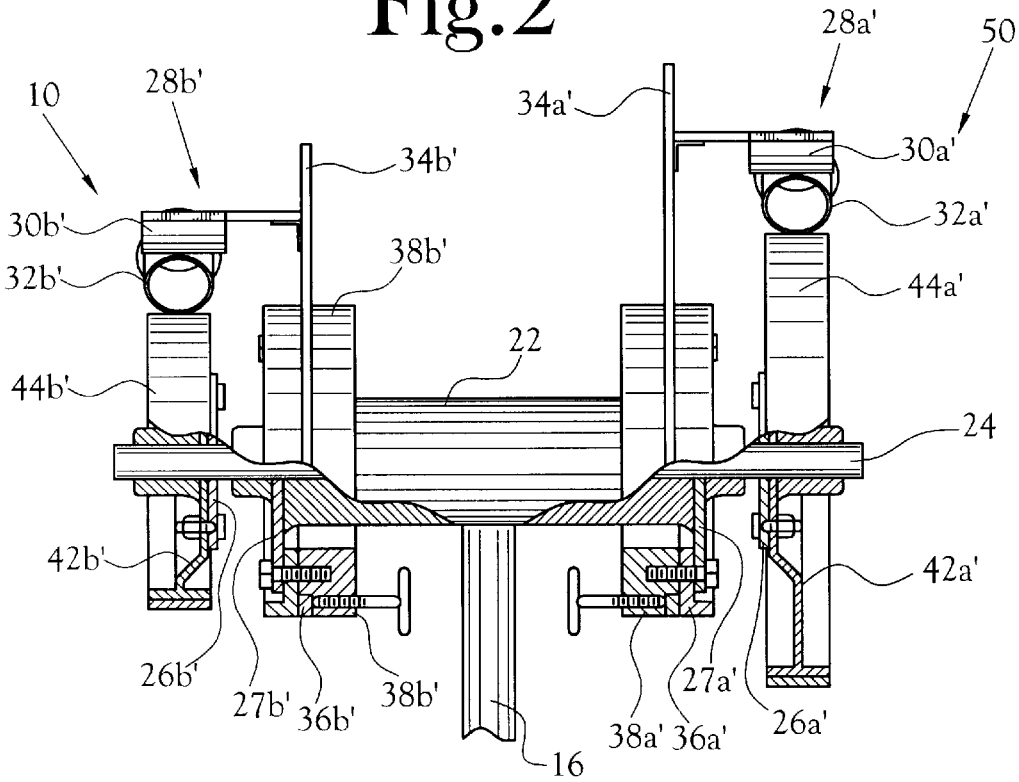

A ball throwing device incorporating various features of the present invention is illustrated generally at 10 in the figures. In FIGS. 1–3, like elements are indicated by common reference numerals. In FIGS. 1 and 2, the elements of the larger wheel are indicated by appending the suffix "a" to the reference numeral and the elements of the smaller wheel are indicated by appending the suffix "b" to the reference numeral. Similarly, in FIG. 3, the elements of the larger wheel are indicated by appending the suffix "a'" to the reference numeral and the elements of the smaller wheel are indicated by appending the suffix "b'" to the reference numeral. The ball throwing device 10 is designed to be portable and pitch balls in a strike zone for batting practice. Moreover, in the preferred embodiment, the ball throwing device 10 is designed to provide a choice of at least two speeds at which the ball can be thrown.

A perspective view of one embodiment of the ball throwing device 10 is shown in FIG. 1 and generally includes a base 12, a motor 20 and at least two ball throwing assemblies 50 each of which includes a wheel 42*a*, 42*b*. The base 12 supports the motor 20 and the motor 20 provides support for and drives the ball throwing assemblies 50.

The structure of the base 12 is well known in the art and shown clearly in FIG. 1. The base 12 includes a tripod leg assembly 14, an extension shaft 16 and a height adjusting means 18. The tripod legs 14 are foldable for storage. The extension shaft 16 is slidable within the height adjusting means 18.

The motor 20 is supported on the extension shaft 16 and includes a drive motor 22 which drives an output shaft 24 to rotate at selectable and variable speeds. In FIGS. 1 and 2, the output shaft 24 extends from one end of the motor 20, and in FIG. 3, the output shaft 24 extends from opposing ends of the motor 20. The motor 20 further includes at least two tire flanges 26*a*, 26*b* and at least one mounting flange 27. The tire flanges 26*a*, 26*b* are securely mounted to the output shaft 24 in a spaced apart manner. The mounting flange 27 is mounted to the body of the motor 20 and does not rotate.

Each ball throwing assembly 50 includes a feeder assembly 28*a*, 28*b* and a wheel 42*a*, 42*b* defining a ball gripping surface 44*a*, 44*b*. Each wheel [42] 42*a*, 42*b* is secured to a respective tire flange 26*a*, 26*b* which is mounted to the output shaft 24, as shown in FIGS. 2 and 3. Further, each wheel 42*a*, 42*b* defines a different diameter and by example, the smaller wheel 42*b* defines a diameter approximately half the diameter of the larger wheel 42*a*. As the tangential velocity of each wheel 42*a*, 42*b* is proportional to the diameter of the wheel 42*a*, 42*b*, providing wheels 42*a*, 42*b* of differing size allows the ball throwing device 10 to throw two differing pitches in the same strike zone without the need for adjustment. The ability to change between pitches in rapid succession is [an] invaluable in batting practice. The ball gripping surface is fabricated from a material which provides a high coefficient of friction such that the ball to be thrown is gripped by the wheel surface. It will be noted that a wheel with a ball gripping surface is depicted in the figures. A tire with a suitable surface would also be appropriate for use with the ball throwing device 10 of the present invention.

Each feeder assembly 28*a*, 28*b* includes a fixed pad 30*a*, 30*b* and a feeder chute 32*a*, 32*b* which are supported proximate the wheel 42*a*, 42*b*. In the preferred embodiment, the fixed pad 30*a*, 30*b* defines an arcuate shape and is preferably fabricated from hard rubber. The fixed pad 30*a*, 30*b* is maintained in a position such that the space between the fixed pad 30*a*, 30*b* and the ball gripping surface 44*a*, 44*b* defines a distance which permits a selected ball to be frictionally gripped by the ball gripping surface 44*a*, 44*b* of the wheel 42*a*, 42*b*. More specifically, the distance between the fixed pad 30*a*, 30*b* and the ball gripping surface 44*a*, 44*b* is slightly less than the diameter of the ball to be thrown such that the fixed pad 30*a*, 30*b* forces the ball against the ball gripping surface 44*a*, 44*b* of the wheel 42*a*, 42*b*. In the embodiment illustrated in FIGS. 1 and 2, the feeder assembly 28*a*, 28*b* for each wheel is supported by a separate support plate 34*a*, 34*b* which is pivotable with respect to the motor 20 such that the location of the feeder chutes 32*a*, 32*b* and fixed pads 30*a*, 30*b* are adjustable with respect to the corresponding wheel 42*a*, 42*b*. Specifically, each support plate 34*a*, 34*b* defines an annular portion 36*a*, 36*b* which is disposed between two base plates 38*a*, 38*b* which are mounted to the mounting flange 27 of the motor 20, as shown in FIG. 2. Those skilled in the art will recognize that the second feeder assembly 28*b* will normally be positioned behind the first feeder assembly 28*a* for any given motor speed so that each ball throwing assembly 50 will throw strikes. Accordingly, the second feeder assembly 28*b* will be mounted such that the second extension plate 40 is rearward of the first feeder assembly 28*a*. It will be noted that any manner for supporting the feeder assembly 28*a*, 28*b* proximate the wheel 42*a*, 42*b* will suffice. Further, it will be noted that, although two ball throwing assemblies 10 are illustrated, the present invention is not limited thereto. More specifically, a plurality of wheels defining varying diameters can be mounted to output shaft 24.

In the embodiment illustrated in FIG. 3, the feeder assemblies 28*a*', 28*b*' for the wheels are independent from each other. Specifically, each feeder assembly 28*a*', 28*b*' includes a support plate 34*a*', 34*b*' which is rotatably mounted between two base plates 38*a*', 38*b*'. The motor includes two mounting flanges 27*a*', 27*b*' mounted to opposing sides of the body of the motor 20. The base plates 38*a*', 38*b*' which support the support plate 34*a*', 34*b*' therebetween are secured to a respective mounting flange 27*a*', 27*b*' which is illustrated in the cutaway portions of FIG. 3.

The ball throwing device 10 of the present invention is capable of throwing balls at the minimum of two different speeds without having to readjust the device 10. More specifically, the device 10 operates on the principles of tangential velocity wherein every point on a rotating rigid body defines the same angular velocity, but the linear or tangential velocity of a point of the rotating body increases as it moves outward from the center of rotation toward the rim. Therefore, in the case of two or more wheels mounted to the same rotating axis, a larger wheel throws a ball at a faster speed than a smaller wheel. It will be noted that the relationship between the tangential and angular velocity is linear such that if the radius is doubled, the tangential velocity is doubled.

In the ball throwing operation, the feeder assembly 28*a*, 28*b* serves to guide the ball and position it against the surface 44*a*, 44*b* of the wheel 42*a*, 42*b* in a frictional manner to throw the ball. The support plate 34*a*, 34*b* which supports the feeder assembly 28*a*, 28*b* is rotatable with respect to the wheel 42*a*, 42*b* to permit aiming of the ball. The ball is fed through the feeder chute 32*a*, 32*b* and guided into the space between wheel surface 44*a*, 44*b* and the fixed pad 30*a*, 30*b*. The space is such that the ball is compressed against the wheel surface 44*a*, 44*b* and gripped in a frictional manner by the rotating wheel surface 44*a*, 44*b* to propel the ball therefrom at a selected velocity. The feeder assembly 28*a*, 28*b* can be rotated around the wheel 42*a*, 42*b* to provide a variety of pitches as well as throwing balls for outfield practice.

The embodiment of the device 10 illustrated in FIGS. 1 and 2 depicts the two wheels 42*a*, 42*b* extending from the same side of the motor 20. Everything beyond the tire flange 26*a*, 26*b* to which the first wheel 42*a* is mounted rotates such that the feeder assembly 28*a*, 28*b* for the second wheel 42*b* can not be mounted to the motor 20 and must extend from the first feeder assembly which is mounted to the mounting flange 27. In the embodiment illustrated in FIG. 3, the feeder assemblies 28*a*', 28*b*' are positionable in an independent manner for more control.

From the foregoing description, it will be recognized by those skilled in the art that a ball throwing device offering advantages over the prior art has been provided. Specifically, the ball throwing device is intended for use during batting practice and is capable of throwing softballs, baseballs, and balls of the like into a hitting zone. Further, the ball throwing device provides a choice of speeds at which a ball can be pitched without having to adjust the device in any way.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A ball throwing device comprising:

a base;

a motor supported on said base, said motor defining a mounting flange, a drive motor and an output shaft driven to rotate by said drive motor, said output shaft including at least two tire flanges carried thereon; and, at least two ball throwing assemblies each of which defines a feeder assembly and a wheel, each of said wheels defining a ball gripping surface and being mounted to one of said at least two tire flanges, a first of each of said wheels defining a first diameter, a second of each of said wheels defining a second diameter, said first diameter being larger than said second diameter, each of said feeder assemblies being supported proximate one of said ball gripping surfaces to guide the ball to be thrown against one of said wheels, each of said feeder assemblies being supported via said mounting flange.

2. The ball throwing device of claim 1 wherein said output shaft extends from one side of said motor such that said at least two ball throwing assemblies are carried in a side by side relationship on said output shaft.

3. The ball throwing device of claim 1 wherein said output shaft extends from both sides of said motor such that said at least two ball throwing assemblies are positioned on opposing sides of said motor.

* * * * *